United States Patent [19]

Courtoy

[11] 4,242,380

[45] Dec. 30, 1980

[54] TREATMENT OF NON-WOVEN FABRIC IN IMPROVEMENTS IN AND RELATING TO ORDER TO IMPROVE THE PROPERTIES THEREOF

[76] Inventor: Jean-Francois Courtoy, 49, rue des Charretiers, Wiltz, Luxembourg

[21] Appl. No.: 46,186

[22] Filed: Jun. 6, 1979

[51] Int. Cl.[3] ..... B05D 3/02; B05D 3/12; B05D 1/28; B32B 27/00

[52] U.S. Cl. ..... 427/366; 427/389.8; 427/393.5; 427/428; 428/246; 428/290

[58] Field of Search ..... 427/365, 366, 390 A, 427/393.5, 428, 389.8; 428/246, 290

[56] References Cited

U.S. PATENT DOCUMENTS

| | | | |
|---|---|---|---|
| 3,573,964 | 4/1971 | Jones | 427/366 |
| 3,773,545 | 11/1973 | Erb et al. | 427/366 X |
| 4,041,197 | 8/1977 | Gagne | 427/366 X |

*Primary Examiner*—Michael R. Lusignan

[57] ABSTRACT

The impregnation of a non-woven fabric with a plastisol is accomplished by first coating the fabric with a heated plastisol having a viscosity in the range of 4 to 30 poise, subsequently pressing the coated fabric against a rotating cylinder which has been heated to within the range of 130° to 180° C. and maintaining the coated fabric in contact with the cylinder for a sufficient time to obtain complete impregnation of the fabric by the plastisol and to gel the plastisol to the side of the fabric disposed away from the cylinder.

4 Claims, 1 Drawing Figure

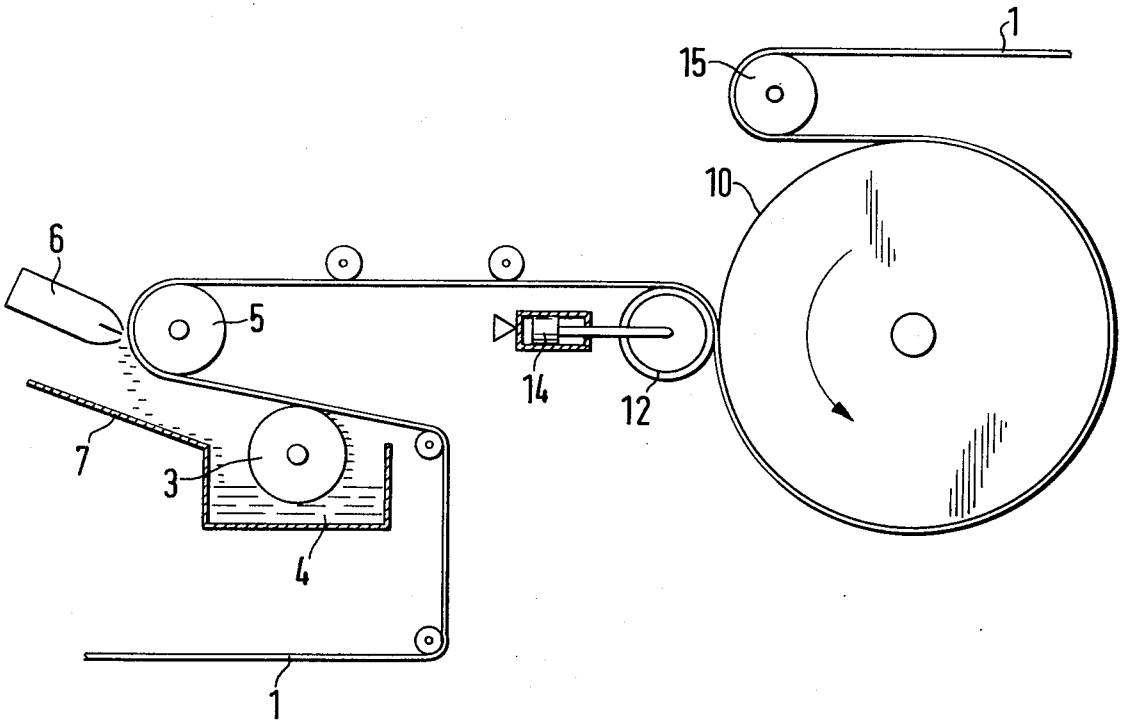
1
15
10
12
14
5
6
7
3
4
1

IMPROVEMENTS IN AND RELATING TO TREATMENT OF NON-WOVEN FABRIC IN ORDER TO IMPROVE THE PROPERTIES THEREOF

The present invention relates to a process intended to improve the physical properties of non-woven fabrics, particularly glass wool, for the purpose of rendering said fabrics more receptive to print. The invention also extends to products obtained by this process.

Non-woven fabrics are generally used as backings for wall coverings, especially for floor coverings.

Less and less use is being made of asbestos for the construction of floor covering backings and efforts have therefore been made to replace asbestos by various other substances, among which glass wool is increasing in importance.

A usual method is to impregnate a sheet of non-woven fabric, usually of fibre glass, with a plastisol, with a double impregnation process in which one application is given to the reverse side in order to stop up the pores and the other to the front in order to obtain a perfectly smooth and non-porous surface, so that in a subsequent heliographic printing process the ink will not "spread" on the support. This "double impregnation" is generally performed in two successive steps.

After this "double impregnation", which in fact is a front-and-back coating operation, the product is gelled in an oven through which the treated fabric is caused to circulate, in most cases continuously.

This process nevertheless suffers from certain drawbacks resulting from the fact that the coating of two surfaces of a sheet of non-woven material which is nevertheless not impregnated all through will frequently cause a certain quantity of air to be trapped in it. Subsequent heat treatments often cause the trapped air to expand under the effect of the heat and to form irregularities on the surface which render the product unsaleable.

The use of a fusing oven also considerably increases the size of the production lines, the said furnace being comparatively long and the output speed very limited.

The present invention thus intends to remedy the aforementioned drawbacks of the existing processes.

According to the present invention a non-woven fabric is impregnated all through by a simple and rapid method in which a plastisol having substantially a Newtonian viscosity, comprised between 4 and 30 poise, is applied at a temperature between 5° and 50° C. to one single surface of the non-woven material, whereafter the impregnated non-woven fabric is pressed by a pressure roller on a cylinder heated to between 130° and 180° C., the impregnated side of the non-woven material being in contact with the said cylinder and at least partially covering the said cylinder.

The said impregnated surface is the side on which the eventual heliographic printing will be carried out.

Under the conditions stated three results are observed which, occuring in combination, were totally unexpected, i.e. the plastisol is completely gelled without the impregnated fabric sticking to the roll, so that a good surface finish is obtained, the fabric is impregnated all through and the reverse side is gelled and dry when leaving the cylinder.

After the cooling the resulting product undergoes heliographic printing and constitutes a semi-finished product serving as a base, particularly for the production of floor and other coverings.

The exact temperature for the treatment is chosen in accordance with the speed at which the product passes over the cylinder and with the diameter of the latter. A skilled operator will have no difficulty in selecting it in accordance with the installation available to him, which largely governs the speed at which the fabric moves and the diameter of the cylinder that can be used, as well as the appropriate temperature, by a series of tests performed in order to determine how to set the equipment in such a way that the fabric will be impregnated all through but will not stick to the roll.

When it passes over a cylinder of about 2 m in diameter at a speed of about 8 to 40 m/min, in such a manner that the material is in contact with approximately 75% of the outer perimeter of the roll, the best temperature will be of the order of 150° C.

In the usual present-day installations a temperature below 130° C. prevents thorough impregnation, while if it is above the level indicated the fluidity will prove excessive, making it difficult to apply the plastisol satisfactorily and resulting in surface finishes which are unsuitable for a subsequent heliographic printing process.

The plastisol is of a type customarily employed for coatings. Within the viscosity range stated, i.e. 4–30 poise, preference is given to a viscosity of 6–15 poise, particularly to about 8 poise. The viscosity range can easily be obtained from commercial plastisol preparations, with the use of conventional dilution agents or, where necessary, thickening agents.

The rheological behaviour of the plastisol adopted may be substantially Newtonian, but slightly pseudoplastic characteristics are nevertheless acceptable. A dilatant plastisol is however to be avoided.

When causing the material to pass over the heated cylinder, the non-impregnated surface is simultaneously pressed with a presser roller, preferably lined with an elastic substance such as rubber.

It is noted that under these circumstances a "pad" of plastisol, which has the effect of creating an even film of this substance, forms upstream from the point of contact between the material and the heated cylinder. This provides a surface in the desired state, similar to that obtained in calendered films. A further unexpected effect, however, is that this "pad" of plastisol remains free of any thickening, which would make application impossible.

In practice the process can be carried out by the method described below by reference to a schematic diagram of a suitable installation for the purpose.

The one single FIGURE attached illustrates a suitable installation for the impregnation of a composite backing consisting of any kind of base to which a sheet of glass fibre is applied.

The FIGURE shows a composite backing 1, consisting of a base and a sheet of glass and conveyed to an applicator roll 3 rotating in a tank containing a plastisol. The surface formed by the sheet of glass is in contact with the applicator roll and is supplied with a suitable quantity of the plastisol.

After this application the film of plastisol applied is smoothed on a return roll by means of an "air knife" 6 for the emission of a thin film of air. The surplus plastisol is collected by a plate 7 integral with the tank 4 and returned to this latter.

The composite backing impregnated in this manner then passes to a heated cylinder 10 to which it is applied by causing it to pass between the said roll and a rubber-covered presser roller 12. A conventional device is used for the purpose of ensuring even application, at adjustable pressure, of the presser roll 12 to the roll 10.

The plastisol-coated surface of the backing is applied to the cylinder 10 in such a way as to cover about 75–80% of the perimeter of the latter, as already indicated, the roll being heated, for example, to a temperature of the order of 150° C.

After passing over the roll the support can be detached from the latter without difficulty and is taken up by a return roll 15, from which it goes to a heliographic printing press, not shown in the drawing.

Among the plastisol compositions which can be used, mention may be made of the following:

| | |
|---|---|
| PVC | 100 |
| Stabilizing agent | 2 |
| Mixture of plasticizer of the phthalate type | 60–120 |
| Charge of crystalline dolomite | 30–200 |
| $TiO_2$: | 0–15 |
| (preferably | 2) |

The sheet of glass may be a conventional product such as a sheet of glass wool treated in such a way as to render it compatible with the PVC such as described in French Pat. No. 2,295,836, P.1, line 15.

In particular, a sheet of glass of the "Schüller" or "Ahlström" type can be used, possibly pre-treated, on a compact or foamable PVC support.

The invention will be described in greater detail by reference to a preferred method of carrying it out, this serving solely as illustration and having no limitative effect.

A composite backing consisting of a base of 280 g/m$^2$ of PVC covered with 60 g/m$^2$ of glass wool is given an application, at the rate of 500 g/m$^2$, of a plastisol of the following composition:

| | |
|---|---|
| PVC | 100. |
| Stabilizer | 2. |
| Mixture of plasticizer of the phthalate type | 90. |
| Charge of crystalline dolomite | 35. |
| $TiO_2$: | 2.5. |

The coating operation by the aid of the plastisol can be carried out in the type of installation described in conjunction with the accompanying drawing, but use can also be made of a coating roll, a coating device of the scraper type, a reverse roll or an equivalent coating device enabling the coating substance to be proportioned in the desired quantity.

The backing thus impregnated is conveyed onto a fusing cylinder 10, such as that shown in the attached diagram, passing under a presser roller 12, regulating the pressure to between 0 and 200 kg and preferably to 40 kg per linear meter.

The roll is heated to 150° C., and under these conditions a support is obtained which can be used for the production of wall coverings or decorative coverings but of which the main purpose is that of floor coverings. This support contains no air occlusions, of which the drawbacks have been mentioned farther back.

The good results obtained by the method of the invention are believed to be due to the selection of a plastisol being substantially Newtonian which undergoes a pressing by the effect of the pressure roller, thus forming a "pad" which remains free of thickening, i.e. a pad which is continuously renewed under production, the fresh material being fed being substantially equal to the material which is used in the operation.

This renewal prevents the fusing of the pad of plastisol by the heating effect of the cylinder.

It should be noted that a clearly pseudo-plastical plastisol should be avoided as the product would not suitably impregnate the fibers while a dilatant plastisol would cause a structuration (i.e. thickening) of the pad.

Although a description has been given of practical examples and suitable installation for the performance of the invention, numerous variants are open to the man of the art and that the invention is not limited to the said examples or to the equipment illustrated.

In particular, for example, the treatment according to the invention can be applied to a sheet of fibre glass alone or to a composite product consisting of a sheet of fibre glass on a base, whether foamable or not.

Furthermore, the non-woven fabric may consist of a material of a different nature from fibre glass.

What is claimed is:

1. A process for the impregnation of non-woven fabric with a plastisol comprising the steps of:

selecting the viscosity of a liquid plastisol so that it has a Newtonian viscosity in the range of 6 to 15 poise;

maintaining the selected plastisol in liquid form at a temperature in the range of 5° to 50° C.;

coating a moving web of non-woven fabric with the liquid plastisol;

heating a rotating cylinder such that it has a surface temperature in the range of between 130° and 180° C.;

urging the plastisol coated non-woven fabric web against the heated cylinder by means of a resilient pressure roll having a diameter which is smaller than the diameter of the heated cylinder to cause the plastisol to impregnate the fabric;

maintaining the plastisol impregnated non-woven fabric web in contact with the heated surface of the cylinder downstream of the pressure roll in the direction of web travel for a sufficient time to cause the plastisol to gel to the surface of the web disposed away from the cylinder; and removing the coated web from the cylinder for further processing prior to fusing of the plastisol.

2. The method of claim 1 wherein the heated cylinder has a diameter of 2 m, the speed of movement of the web is in the range of 8 to 40 m/min and wherein the step of maintaining the web in contact with the cylinder comprises:

causing the web to be in contact with at least 75% of the outer periphery of the cylinder.

3. The method of claim 1 wherein the viscosity of the plastisol is maintained at 8 poise.

4. The method of claim 2 wherein the viscosity of the plastisol is maintained at 8 poise.

* * * * *